US009615439B2

(12) United States Patent
Bezel et al.

(10) Patent No.: US 9,615,439 B2
(45) Date of Patent: Apr. 4, 2017

(54) SYSTEM AND METHOD FOR INHIBITING RADIATIVE EMISSION OF A LASER-SUSTAINED PLASMA SOURCE

(71) Applicant: KLA-Tencor Corporation, Milpitas, CA (US)

(72) Inventors: Ilya Bezel, Sunnyvale, CA (US); Anatoly Shchemelinin, Pleasanton, CA (US); Kenneth P. Gross, San Carlos, CA (US); Richard Solarz, Danville, CA (US); Lauren Wilson, San Jose, CA (US); Rahul Yadav, Sunnyvale, CA (US); Joshua Wittenberg, Fremont, CA (US); Anant Chimmalgi, San Jose, CA (US); Xiumei Liu, Fremont, CA (US); Brooke Bruguier, San Jose, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 14/989,348

(22) Filed: Jan. 6, 2016

(65) Prior Publication Data

US 2016/0205758 A1 Jul. 14, 2016

Related U.S. Application Data

(60) Provisional application No. 62/101,835, filed on Jan. 9, 2015, provisional application No. 62/172,373, filed on Jun. 8, 2015.

(51) Int. Cl.
*H05G 2/00* (2006.01)
*H01J 65/00* (2006.01)

(52) U.S. Cl.
CPC ..... *H05G 2/008* (2013.01); *H01J 65/00* (2013.01); *H05G 2/003* (2013.01)

(58) Field of Classification Search
USPC ..... 250/504 R
See application file for complete search history.

(56) References Cited

U.S. PATENT DOCUMENTS 4,167,463 A * 9/1979 Conrad ..... C01B 21/203 204/157.41
7,786,455 B2 8/2010 Smith
(Continued)

FOREIGN PATENT DOCUMENTS

WO 2010007015 A1 1/2010

OTHER PUBLICATIONS

PCT Search Report dated Apr. 25, 2016 for Application No. PCT/US2016/012707, 3 pages.
(Continued)

*Primary Examiner* — Kiet T Nguyen
(74) *Attorney, Agent, or Firm* — Suiter Swantz pc llo

(57) ABSTRACT

A system for forming a laser-sustained plasma includes a gas containment element, an illumination source configured to generate pump illumination, and a collector element. The gas containment element is configured to contain a volume of a gas mixture. The collector element is configured to focus the pump illumination from the pumping source into the volume of the gas mixture contained within the gas containment element in order to generate a plasma within the volume of the gas mixture that emits broadband radiation. The gas mixture filters one or more selected wavelengths of radiation emitted by the plasma.

31 Claims, 11 Drawing Sheets

(56) References Cited

U.S. PATENT DOCUMENTS

| | | | | |
|---|---|---|---|---|
| 9,099,292 | B1 | 8/2015 | Bezel | |
| 9,185,788 | B2 | 11/2015 | Bezel et al. | |
| 2007/0228288 | A1 | 10/2007 | Smith | |
| 2007/0228300 | A1 | 10/2007 | Smith | |
| 2011/0291566 | A1* | 12/2011 | Bezel | G21B 1/23 315/111.21 |
| 2013/0003384 | A1 | 1/2013 | Bezel et al. | |
| 2013/0106275 | A1 | 5/2013 | Chimmalgi | |
| 2013/0181595 | A1 | 7/2013 | Bezel et al. | |
| 2013/0342105 | A1 | 12/2013 | Shchemelinin et al. | |
| 2014/0042336 | A1 | 2/2014 | Bezel et al. | |
| 2014/0291546 | A1 | 10/2014 | Bezel et al. | |
| 2015/0168847 | A1* | 6/2015 | Solarz | H01S 3/094 355/67 |
| 2015/0333471 | A1* | 11/2015 | Chimmalgi | G02B 6/4296 250/504 R |
| 2016/0084757 | A1* | 3/2016 | Miron | G01N 21/39 356/437 |

OTHER PUBLICATIONS

A. Schreiber et al., Radiation resistance of quartz glass for VUV discharge lamps, Journal of Physics D: Applied Physics, Aug. 19, 2005, p. 3242-3250, vol. 38, IOP Publishing Ltd, Printed in the UK.
U.S. Appl. No. 14/231,196, filed Mar. 31, 2014, Ilya Bezel.

* cited by examiner

SYSTEM AND METHOD FOR INHIBITING RADIATIVE EMISSION OF A LASER-SUSTAINED PLASMA SOURCE

CROSS-REFERENCE TO RELATED APPLICATION

The present application claims the benefit under 35 U.S.C. §119(e) of U.S. Provisional Application Ser. No. 62/101,835 filed Jan. 9, 2015, entitled REDUCING EXCIMER EMISSION FROM LASER-SUSTAINED PLASMAS (LSP), naming Ilya Bezel, Anatoly Shchemelinin, Kenneth P. Gross, and Richard Solarz as inventors, which is incorporated herein by reference in the entirety. The present application additionally claims the benefit under 35 U.S.C. §119(e) of U.S. Provisional Application Ser. No. 62/172,373 filed Jun. 8, 2015, entitled GAS MIXTURES FOR BRIGHTER LSP LIGHTSOURCE FOR VIS-NIR APPLICATIONS, naming Ilya Bezel, Anatoly Shchemelinin, Lauren Wilson, Rahul Yadav, Joshua Wittenberg, Anant Chimmalgi, Xiumei Liu, and Brooke Bruguier as inventors, which is incorporated herein by reference in the entirety.

TECHNICAL FIELD

The present disclosure relates generally to plasma-based light sources, and, more particularly, to laser-sustained plasma light sources with gas mixtures for inhibiting selected wavelengths from being emitted in the broadband spectrum emitted by the plasma light source.

BACKGROUND

As the demand for integrated circuits having ever-smaller device features continues to increase, the need for improved illumination sources used for inspection of these ever-shrinking devices continues to grow. One such illumination source includes a laser-sustained plasma (LSP) source. LSP sources are capable of producing high-power broadband light. Laser-sustained plasma sources operate by focusing laser radiation into a gas volume in order to excite the gas into a plasma state, which is capable of emitting light. This effect is typically referred to as "pumping" the plasma. However, broadband radiation emitted by the generated plasma may include one or more undesired wavelengths. For example, undesired wavelengths may be absorbed by elements such as, but not limited to, a transmission element, a reflective element, a focusing element, or components associated with the LSP light source. In some applications, the absorption of undesired wavelengths may lead to damage, degradation, or failure. Therefore, it would be desirable to provide a system and method for curing defects such as those identified above.

SUMMARY

A system for forming a laser-sustained plasma is disclosed, in accordance with one or more illustrative embodiments of the present disclosure. In one illustrative embodiment, the system includes a gas containment element. In another illustrative embodiment, the gas containment element is configured to contain a volume of a gas mixture. In another illustrative embodiment, the system includes an illumination source configured to generate pump illumination. In another illustrative embodiment, the system includes a collector element configured to focus the pump illumination from the pumping source into the volume of the gas mixture contained within the gas containment element in order to generate a plasma within the volume of the gas mixture. In another illustrative embodiment, the plasma emits broadband radiation. In another illustrative embodiment, the gas mixture inhibits the emission of one or more selected wavelengths of radiation from the gas containment element.

A plasma lamp for forming a laser-sustained plasma is disclosed, in accordance with one or more illustrative embodiments of the present disclosure. In one illustrative embodiment, the system includes a gas containment element. In another illustrative embodiment, the gas containment element is configured to contain a volume of a gas mixture. In another illustrative embodiment, the gas mixture is further configured to receive pump illumination in order to generate a plasma within the volume of the gas mixture. In another illustrative embodiment, the plasma emits broadband radiation. In another illustrative embodiment, the gas mixture inhibits the emission of one or more selected wavelengths of radiation from the gas containment element.

A method for generating laser-sustained plasma light is disclosed, in accordance with one or more illustrative embodiments of the present disclosure. In one illustrative embodiment, the method includes generating pump illumination. In another illustrative embodiment, the method includes containing a volume of a gas mixture within a gas containment structure. In another illustrative embodiment, the method includes focusing at least a portion of the pump illumination to one or more focal spots within the volume of the gas mixture to sustain a plasma within the volume of the gas mixture. In another illustrative embodiment, the plasma emits broadband radiation. In another illustrative embodiment, the method includes inhibiting the emission of one or more selected wavelengths of radiation from the gas containment structure via the gas mixture.

BRIEF DESCRIPTION OF DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Referring generally to FIGS. 1 through 6, a system for generating a laser-sustained plasma is described in accordance with one or more embodiments of the present disclosure. Embodiments of the present disclosure are directed to a laser-sustained plasma source with a gas mixture designed to sustain a plasma that emits broadband light and simultaneously inhibits the emission of selected wavelengths. Embodiments of the present disclosure are directed to the incorporation of one or more gases into a gas mixture in a LSP source to selectively absorb emission of selected wavelengths of radiation emitted by the plasma. Additional embodiments of the present disclosure are directed to the incorporation of one or more gases into a gas mixture in a LSP source to quench emission of excimers in the gas mixture. Additional embodiments are directed to gas mixtures that produce light emission with high spectral intensity in ultraviolet, visible and/or infrared spectral regions with limited brightness in undesirable spectral regions.

FIGS. 1A through 5 illustrate a system 100 for forming a laser-sustained plasma, in accordance with one or more embodiments of the present disclosure. The generation of plasma within inert gas species is generally described in U.S. patent application Ser. No. 11/695,348, filed on Apr. 2, 2007; and U.S. Patent Publication No. 2007/0228288, filed on Mar. 31, 2006, which are incorporated herein by reference in their entirety. Various plasma cell designs and plasma control mechanisms are described in U.S. Patent Publication No. 2013/0106275, filed on Oct. 9, 2012, which is incorporated herein by reference in the entirety. The generation of plasma is also generally described in U.S. Patent Publication No. 2014/0291546, filed on Mar. 25, 2014, which is incorporated by reference herein in the entirety. Plasma cell and control mechanisms are also described in U.S. patent application Ser. No. 14/231,196, filed on Mar. 31, 2014, which is incorporated by reference herein in the entirety. Plasma cell and control mechanisms are also described in U.S. Pat. No. 9,185,788, filed on May 27, 2014, which is incorporated by reference herein in the entirety. Plasma cell and control mechanisms are also described in U.S. Patent Publication No. 2013/0181595, filed on Jan. 15, 2013, which is incorporated by reference herein in the entirety. In a general sense, the system 100 should be interpreted to extend to any plasma based light source known in the art.

Figure 1A:
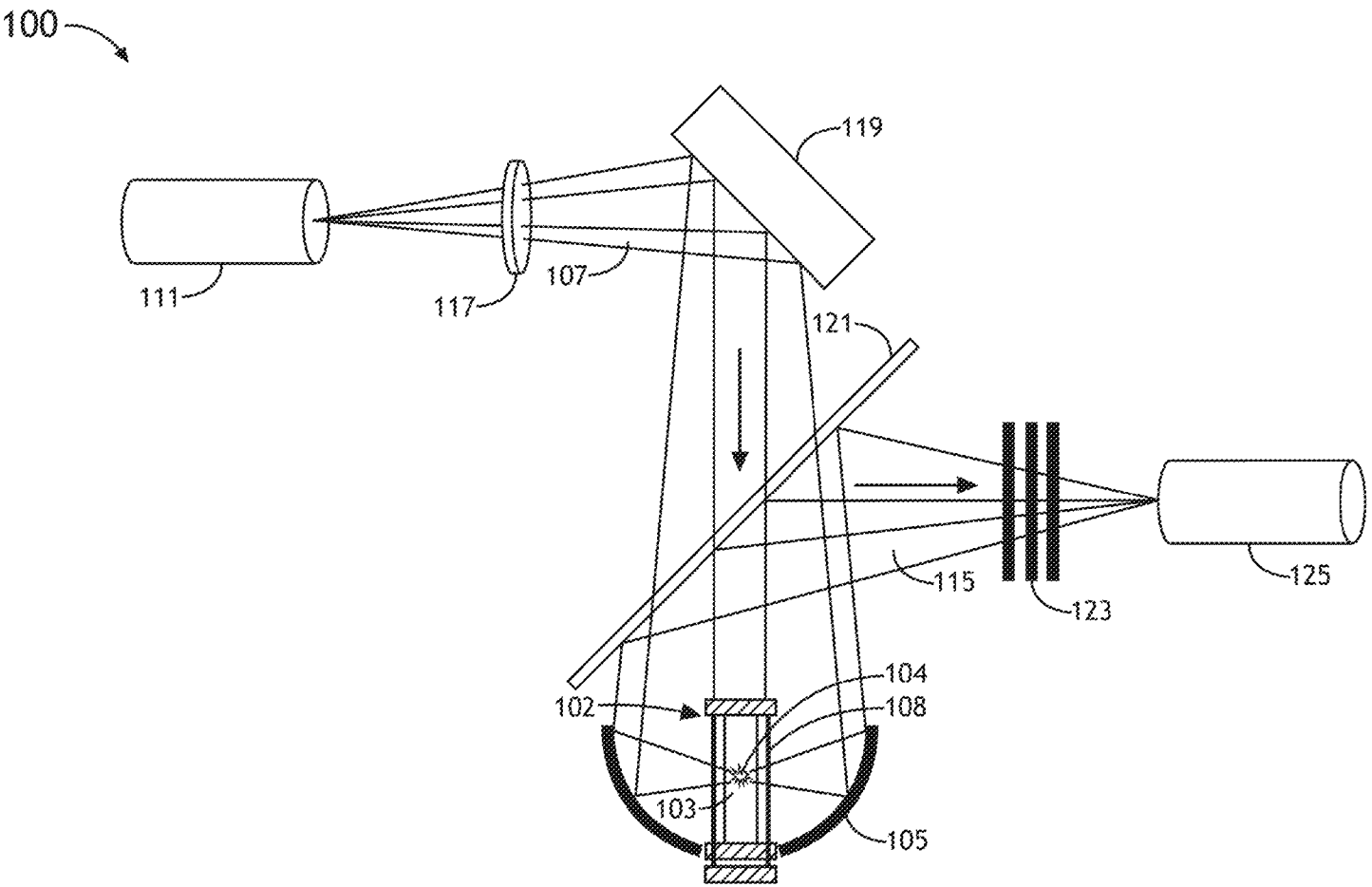
FIG. 1A is a schematic diagram illustrating a system for forming a laser-sustained plasma, in accordance with one embodiment of the present disclosure.

Referring to FIG. 1A, in one embodiment, the system 100 includes an illumination source 111 (e.g., one or more lasers) configured to generate pump illumination 107 of a selected wavelength, or wavelength range, such as, but not limited to, infrared radiation or visible radiation. In another embodiment, the system 100 includes a gas containment structure 102 (e.g. for generating, or maintaining, a plasma 104). The gas containment structure 102 may include, but is not limited to, a plasma cell (see FIG. 1B), a plasma bulb (see FIG. 1C), or a chamber (see FIG. 1D). Focusing pump illumination 107 from the illumination source 111 into the volume of gas 103 causes energy to be absorbed through one or more selected absorption lines of the gas or plasma 104 within the gas containment structure 102, thereby "pumping" the gas species in order to generate or sustain plasma 104. In another embodiment, although not shown, the gas containment structure 102 may include a set of electrodes for initiating the plasma 104 within the internal volume of the gas containment structure 102, whereby the illumination 107 from the illumination source 111 maintains the plasma 104 after ignition by the electrodes.

In another embodiment, the system 100 includes a collector element 105 (e.g., an ellipsoidal or a spherical collector element) configured to focus illumination emanating from the illumination source 111 into a volume of gas 103 contained within the gas containment structure 102. In another embodiment, the collector element 105 is arranged to collect broadband illumination 115 emitted by plasma 104 and direct the broadband illumination 115 to one or more additional optical elements (e.g., filter 123, homogenizer 125 and the like). In another embodiment, the gas containment structure 102 includes one or more transparent portions 108 configured to transmit pump illumination 107 into the gas containment structure 102 and/or transmit broadband illumination 115 from the plasma 104 outside of the gas containment structure 102.

In another embodiment, the system 100 includes one or more propagation elements configured to direct and/or process light emitted from the gas containment structure 102. For example the one or more propagation elements may include, but are not limited to, transmissive elements (e.g. a transparent portion 108 of the gas containment structure 102, one or more filters 123, and the like), reflective elements (e.g. the collector element 105, mirrors to direct the broadband illumination 115, and the like), or focusing elements (e.g. lenses, focusing mirrors, and the like).

It is noted herein that broadband emission 115 of plasma light is generally influenced by a multitude of factors including, but not limited to, the focused intensity of pump illumination 107 from the illumination source 111, the temperature of the volume of gas 103, the pressure of the volume of gas 103, and/or the composition of the volume of gas 103. Further, spectral content of broadband radiation 115 emitted by the plasma 104 and/or the gas mixture 103 may include, but is not limited to, infrared (IR), visible, ultraviolet (UV), vacuum ultraviolet (VUV), deep ultraviolet (DUV), or extreme ultraviolet (EUV) wavelengths. In one embodiment, the plasma 104 emits visible and IR radiation with wavelengths in at least the range of 600 to 1000 nm. In another embodiment, the plasma 104 emits visible and UV radiation with wavelengths in at least the range of 200 to 600 nm. In another embodiment, the plasma 104 emits at least short-wavelength radiation having a wavelength below 200 nm. It is noted herein that the present disclosure is not limited to the wavelength ranges described above and the plasma 104 may emit light having wavelengths in one or any combination of the ranges provided above.

In certain applications, only a portion of the spectral content of broadband radiation emitted by the plasma 104 and/or gas mixture 103 is desired. In some embodiments, the gas mixture 103 contained within the gas containment structure 102 inhibits the emission of one or more select wavelengths of radiation from the gas containment structure 102. In this regard, one or more components of the gas mixture 103 serve to selectively reduce the intensity of undesired wavelengths of radiation generated by the plasma 104 and/or the gas mixture 103.

An LSP light source in which undesired wavelengths have been inhibited by the gas mixture 103 may be generally useful for tailoring the output of the light source. In this regard, one measure of performance for a light source in a given application is the ratio of the radiant power for desired spectral regions relative to the total radiant power of the LSP source. In this regard, performance of the LSP light source may be improved by increasing the radiant power for desired spectral regions relative to the radiant power of undesired spectral regions. In one embodiment, the gas containment structure 102 contains a gas mixture 103 that inhibits the emission of undesired wavelengths of radiation emitted from the gas containment structure 102 to diminish the spectral power of undesired wavelengths and thereby improve performance of the LSP source. Further, the use of a gas mixture 103 with one or more gas components configured to inhibit undesired wavelengths may enable a wider range of suitable gases for LSP light sources. For example, a plasma 104 generated in an identified gas may exhibit high spectral power for wavelengths in a desired spectral region, but may be impractical due to problematic spectral power for wavelengths in undesired spectral regions. In one embodiment, the high spectral power for wavelengths in desired spectral regions may be utilized by adding one or more gas components to the identified gas to generate a gas mixture 103 in which wavelengths in undesired spectral wavelengths are inhibited.

In another embodiment, the gas containment structure 102 contains a gas mixture 103 that inhibits the emission of undesired wavelengths of radiation corresponding to absorption bands of one or more components of the system 100. The one or more components of the system 100 may include, but are not limited to, one or more propagation elements in the system 100 or one or more elements beyond the system 100. As previously noted, the one or more propagation elements may include, but are not limited to, one or more transmissive elements (e.g. a transparent portion 108 of the gas containment structure 102, one or more filters 123, and the like), one more reflective elements (e.g. the collector element 105, mirrors to direct the broadband illumination 115, and the like), or one or more focusing elements (e.g. lenses, focusing mirrors, and the like) For example, applications utilizing a LSP source for the generation of visible and/or infrared radiation may include optical components sensitive to smaller wavelength radiation including, but not limited to, UV, VUV, DUV, or EUV radiation. It is noted herein that many optical components (e.g. transparent portions 108 of the gas containment structure 102, lenses, mirrors, and the like) configured for visible and/or infrared illumination may absorb smaller wavelength radiation, which may lead to heating, degradation, or damage of the element. In some cases, absorption of radiation within a transparent portion 108 of the gas containment structure 102 or additional optical elements in the system induces solarization that limits the performance and/or operational lifespan of the component. As another example, one or more components of the system 100 may be sensitive to select wavelengths within visible or infrared spectral regions.

Inhibiting radiation using the gas mixture 103 contained in the gas containment structure 102 may mitigate potential incubation effects associated with long term-exposure to undesired wavelengths of radiation. In one embodiment, gas mixture 103 is circulated in the gas containment structure 102 (e.g. by natural or forced circulation) such that incubation effects associated with continued exposure to radiation emitted by the plasma 104 are avoided. For example, circulation may mitigate modifications of the temperature, pressure, or species within the gas mixture 103 that may impact the emission of radiation from the gas containment structure 102.

In one embodiment, the gas mixture 103 contained within the gas containment structure 102 simultaneously sustains the plasma 104 and inhibits the emission of one or more select undesired wavelengths of radiation from the gas containment structure 102. It is noted herein that the relative concentrations of gas components within the gas mixture 103 may impact both the spectrum of broadband radiation 115 emitted by the plasma 104 as well as the spectrum of radiation inhibited by the gas mixture 103. In this regard, the spectrum of broadband radiation 115 emitted by the plasma and the spectrum of radiation inhibited (e.g., absorbed or quenched) by the gas mixture 103 may be adjusted by controlling the relative composition of gas components within the gas mixture.

Figure 2:
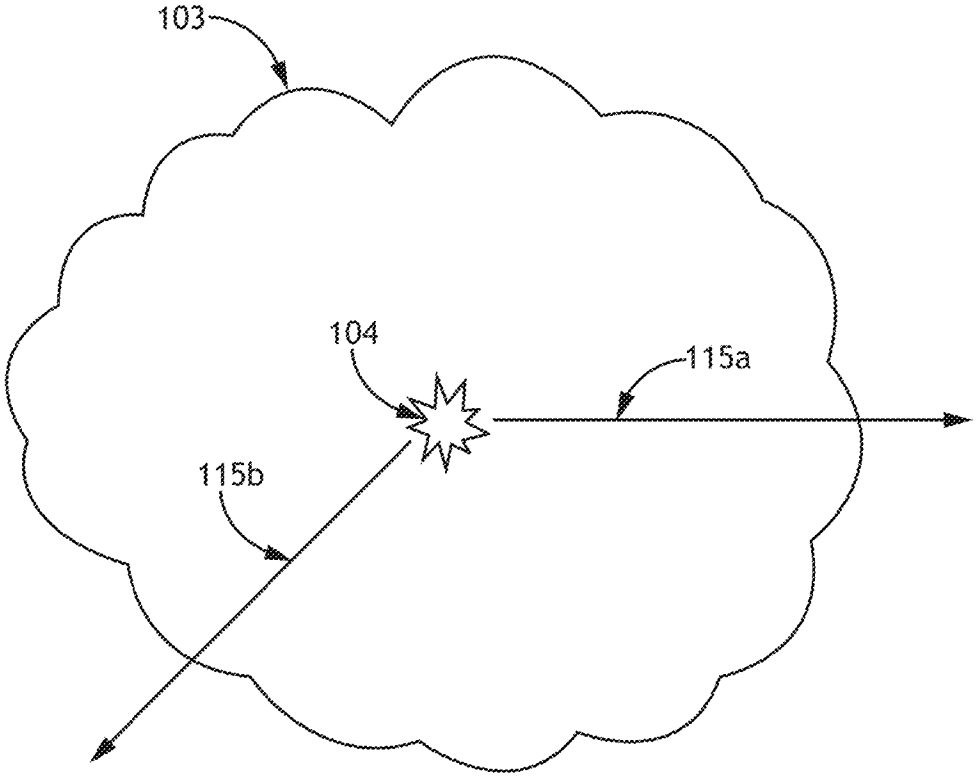
FIG. 2 is a conceptual diagram illustrating a plasma formed within a volume of a gas mixture, in accordance with one embodiment of the present disclosure.

In one embodiment, the gas mixture 103 contained within the gas containment structure 102 absorbs one or more selected wavelengths of radiation emitted by the plasma 104. FIG. 2 is a simplified diagram illustrating the plasma 104 within a volume of the gas mixture 103 in which selected wavelengths of radiation emitted by the plasma 104 are absorbed by the gas mixture 103. In one embodiment, broadband radiation 115*a*, 115*b* is emitted by the plasma 104. In another embodiment, the gas containment structure 102 is configured such that the size of the plasma 104 is substantially smaller than the size of the surrounding gas mixture 103. As a result, broadband radiation 115*a*, 115*b* emitted by the plasma 104 propagates through a distance of gas substantially larger than the size of the plasma 104. The gas containment structure 102 may be configured such that size of the gas mixture 103 is a factor of two or more times the size of the plasma. As another example, the gas containment structure 102 may be configured such that size of the gas mixture 103 is one or more orders of magnitude larger than the size of the plasma 104.

In another embodiment, one or more gas components of the gas mixture 103 selectively absorb one or more selected wavelengths of radiation 115*a* emitted by the plasma such that the intensities of the one or more selected wavelengths of radiation 115*a* are attenuated during propagation through the volume of the gas mixture 103. It is noted herein that the degree to which the one or more selected wavelengths of radiation 115*a* are absorbed is related at least in part to the strength of absorption by the gas mixture 103 at the one or more selected wavelengths as well as the distance the radiation 115*a* propagates through the gas mixture 103. In this regard, the same total attenuation may be achieved by a relatively strong absorption of the one or more selected wavelengths over a short propagation distance or a relatively weak absorption of the one or more selected wavelengths over a longer propagation distance.

In another embodiment, the gas mixture 103 is transparent to one or more additional wavelengths of radiation 115*b* emitted by the plasma 104 such that the spectral intensities of the one or more additional wavelengths of radiation 115*b* are not attenuated during propagation through the volume of the gas mixture 103. Consequently, the gas mixture 103 may selectively filter one or more selected wavelengths of the broadband radiation spectrum of radiation 115 emitted by the plasma 104.

It is contemplated herein that the system 100 may be utilized to initiate and/or sustain a plasma 104 using a variety of gas mixtures 103. In one embodiment, the gas mixture 103 used to initiate and/or maintain the plasma 104 may include a noble gas, an inert gas (e.g., noble gas or non-noble gas) and/or a non-inert gas (e.g., mercury). In another embodiment, the gas mixture 103 includes a mixture of a gas (e.g., noble gas, non-noble gases and the like) and one or more gaseous trace materials (e.g., metal halides, transition metals and the like). For example, gases suitable for implementation in the present disclosure may include, but are not limited, to Xe, Ar, Ne, Kr, He, $N_2$, $H_2O$, $O_2$, $H_2$, $D_2$, $F_2$, $CH_4$, metal halides, halogens, Hg, Cd, Zn, Sn, Ga, Fe, Li, Na, K, TI, In, Dy, Ho, Tm, ArXe, ArHg, ArKr, ArRn, KrHg, XeHg, and the like. In a general sense, the present disclosure should be interpreted to extend to any LSP system and any type of gas mixture suitable for sustaining a plasma 104 within a gas containment structure 102.

It is noted herein that much of the emission from atomic elements in a gas mixture 103 pumped in a LSP source is a result of line emission of highly-excited electron states of neutral species. In this regard, the gas mixture 103 may include any gas component suitable for emitting radiation 115 when pumped by an illumination beam 107. For example, an LSP source configured to generate illumination 115 in the spectral range of 600 nm to 1000 nm may include a gas mixture include one or more of the following gases: He, Ne, Ar, Kr, Xe, Rn, C, N, or O. Specifically, it is noted herein that there are at least 125 lines of He I, at least 209 lines of Ne I, at least 159 lines of Ar I, at least 239 lines of Kr I, at least 376 lines of Xe I, at least 47 lines of Rn I, at least 138 lines of C, at least 208 lines of N and at least 148 lines of O available to emit radiation in the spectral range of 600 to 1000 nm. Further, Na has emission lines at least at 819 nm, 616 nm and 767 nm; and K has emission lines at least at 766 nm and 770 nm suitable for generating emission 115 in a LSP source.

In one embodiment, the gas mixture 103 contained within the gas containment structure 102 includes a first gas component and at least a second gas component. For example, the gas mixture 103 may include, but is not limited to, a first gas component having a partial pressure of at least 10 atm and a second gas component having a partial pressure less than 20% of the first partial pressure. For instance, the first gas component may include, but is not limited to, one or more of argon and/or neon with a partial pressure of at least 10 atm, while the second gas component may include, but is not limited to, one or more of xenon, krypton, and/or radon with a partial pressure of less than 20% of the partial pressure of the first gas component.

For example, the gas mixture 103 contained within the gas containment structure 102 includes argon mixed with krypton, xenon, and/or radon. It is noted that the addition of krypton, xenon and/or radon serves to absorb radiation emitted by the plasma 104 in a selected wavelength region (e.g. VUV radiation). For example, the gas mixture 103 contained within the gas containment structure 102 may include, but is not limited to, argon with a partial pressure of 10 atm and xenon with a partial pressure of 2 atm. A gas mixture 103 including argon and a small concentration of xenon may include a pressure-broadened absorption band in the range of 145-150 nm and broad absorption for wavelengths shorter than 130 nm due at least in part to ground state absorption of light by the gas mixture 103. By way of another example, the gas mixture 103 contained within the gas containment structure 102 includes neon mixed krypton, xenon, and/or radon to absorb VUV radiation in a select wavelength region (e.g. VUV radiation) emitted by a plasma 104.

By way of another example, the gas mixture 103 contained within the gas containment structure 102 includes argon with a partial pressure of 10 atm and radon with a partial pressure of 2 atm. A gas mixture 103 including argon and radon may include absorption bands for wavelengths around 145 nm and 179 nm as well as for shorter wavelengths associated with ground state absorption by the gas mixture 103. By way of another example, the gas mixture 103 contained within the gas containment structure 102 includes argon with a partial pressure of 10 atm, radon with a partial pressure of 1 atm, and xenon with a partial pressure of 1 atm. It is noted that including both xenon and radon in the gas mixture 103 serves to cause the gas mixture to substantially absorb VUV wavelengths emitted by the plasma 104.

In another embodiment, the gas mixture 103 contained within the gas containment structure 102 includes one or more gas components configured to quench the emission of excimers in the gas mixture 103. Consequently, excimers may form within the volume of gas outside of the generated plasma 104 at temperatures low enough to maintain a bound excimer state. It is further noted that excimers may emit radiation in the ultraviolet spectrum upon relaxation to a ground state. For example, $Ar_2$* excimers may emit at 126 nm, $Kr_2$* excimers may emit at 146 nm, and $Xe_2$* excimers may emit at 172 nm or 175 nm.

It is noted herein that the gas mixture 103 may include any gas component known in the art suitable to quench excimer emission. The gas mixture 103 may include one or more gas components suitable for quenching emission from any type of excimer known in the art including, but not limited to, homonuclear excimers of rare gas species, heteronuclear excimers of rare gas species, homonuclear excimers of one or more non-rare gas species, or heteronuclear excimers of one or more non-rare gas species. It is further noted that temperatures low enough to support bound excimer states may also support molecular species as well as atomic species to quench excimer emission. For example, the gas mixture 103 may contain, but is not limited to, $O_2$, $N_2$, $CO_2$, $H_2O$, $SF_6$, $I_2$, $Br_2$, or Hg to quench excimer emission. Additionally, the gas mixture 103 contained in the gas containment structure 102 may include one or more gas components typically unsuitable for use in alternative light sources. For example, the gas mixture 103 may include gases such as, but not limited to, $N_2$ and $O_2$, which are typically not used in arc lamps as these gases may degrade components, such as, but not limited to, electrodes.

It is further noted herein that one or more gas components of a gas mixture 103 may quench excimer emission through any pathway known in the art. For example, one or more gas components of a gas mixture 103 may, but are not limited to, quench excimer emission via collisional dissociation, photolytic processes, or resonance excitation transfer. Additionally, one or more gas components of a gas mixture 103 may quench excimer emission through absorption of radiation emitted by excimers within the gas mixture 103.

In one embodiment, the gas mixture 103 contained in the gas containment structure 102 includes xenon and at least one of $O_2$ or $N_2$ to quench emission from $Xe_2$* excimers generated in the gas mixture 103. In another embodiment, the gas mixture 103 contained in the gas containment structure 102 includes argon and at least one of xenon or $N_2$ to quench emission from $Ar_2$* excimers generated in the gas mixture 103. In another embodiment, the gas mixture 103 contained in the gas containment structure 102 includes neon and $H_2$ to quench emission from $Ne_2$* excimers generated in the gas mixture 103.

Figure 3:
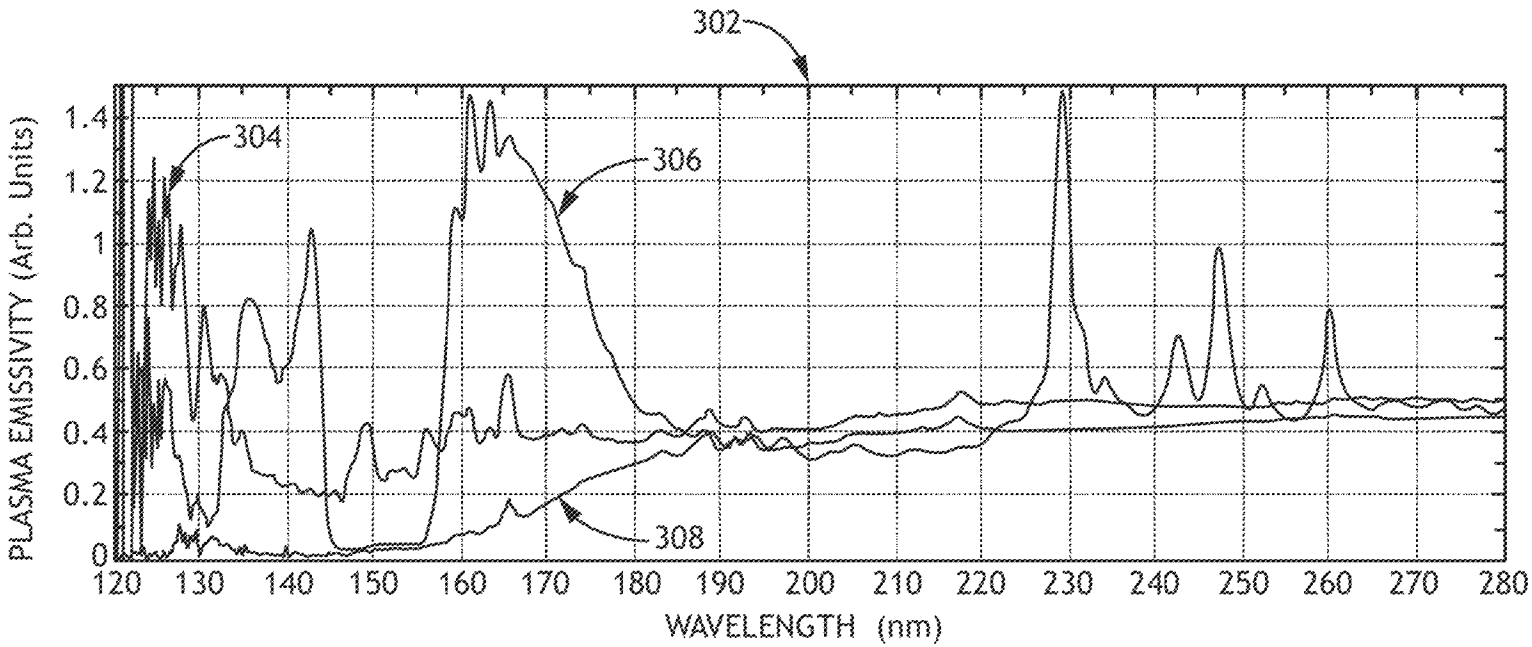
FIG. 3 is a plot of the emission spectrum in the range of 120 nm to approximately 280 nm of a plasma formed in various gases, in accordance with one embodiment of the present disclosure.

FIG. 3 is a graph 302 illustrating the quenching of excimer emission in a LSP light source in the spectral range of 120 nm to 280 nm, in accordance with one or more embodiments of the present disclosure. The emission spectrum of argon at a pressure of 30 atm is shown in plot 304, which includes significant excimer emission in a band around 126 nm. The emission spectrum of xenon at a pressure of 18 atm is shown in plot 306, which includes multiple emission peaks below 200 nm. The emission spectrum of argon at a pressure of 26 atm in a crystalline quartz cell is shown in plot 308. It is noted herein that excimer emission bands shown in plot 504 are significantly quenched in plot 308. In this regard, FIG. 3 illustrates a gas containment structure 102 containing a gas mixture 103 in which excimer emission is quenched.

It is noted herein that the gas mixture 103 may include gas components suitable for use in alternative light sources such as, but not limited to, metal halide lamps or arc lamps. In one embodiment, the gas containment structure 102 is a metal halide lamp. Further, the gas mixture 103 may include elements typically undesirable for use in alternative light sources. For example, the gas mixture 103 for an LSP source may include gases such as, but not limited to, $N_2$ and $O_2$, which are typically not used in arc lamps as these elements can degrade the electrodes of an arc lamp. Additionally, laser-sustained plasmas may reach higher temperature ranges than arc lamps such that gas components may emit radiation at different energy levels when used in an LSP source compared to an arc lamp. In this way, high temperatures accessible by LSP sources enable emission with high brightness in the visible and infrared spectral regions according to the black body limit.

Figure 4A:
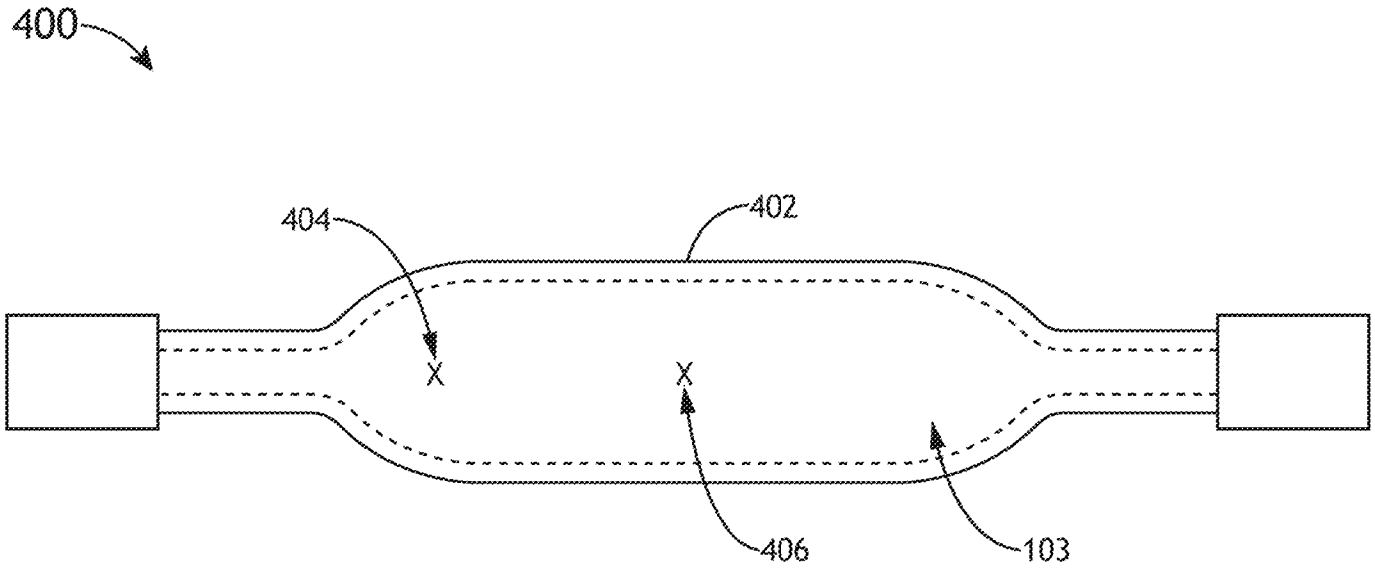
FIG. 4A is a schematic diagram of an elongated plasma bulb, in accordance with one embodiment of the present disclosure.
Figure 4B:
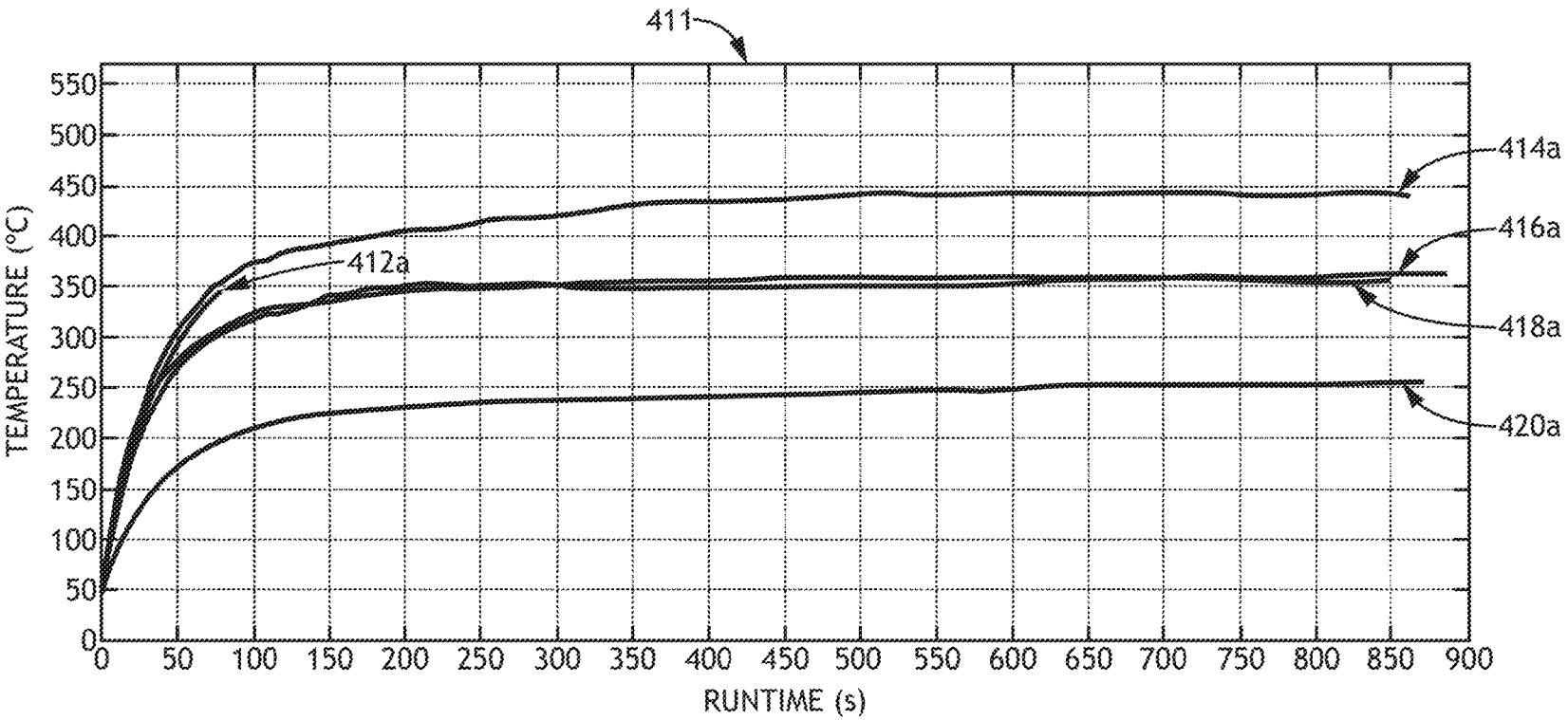
FIG. 4B is a plot of the top shoulder temperature of an elongated plasma bulb containing various gases, in accordance with one embodiment of the present disclosure.
Figure 4C:
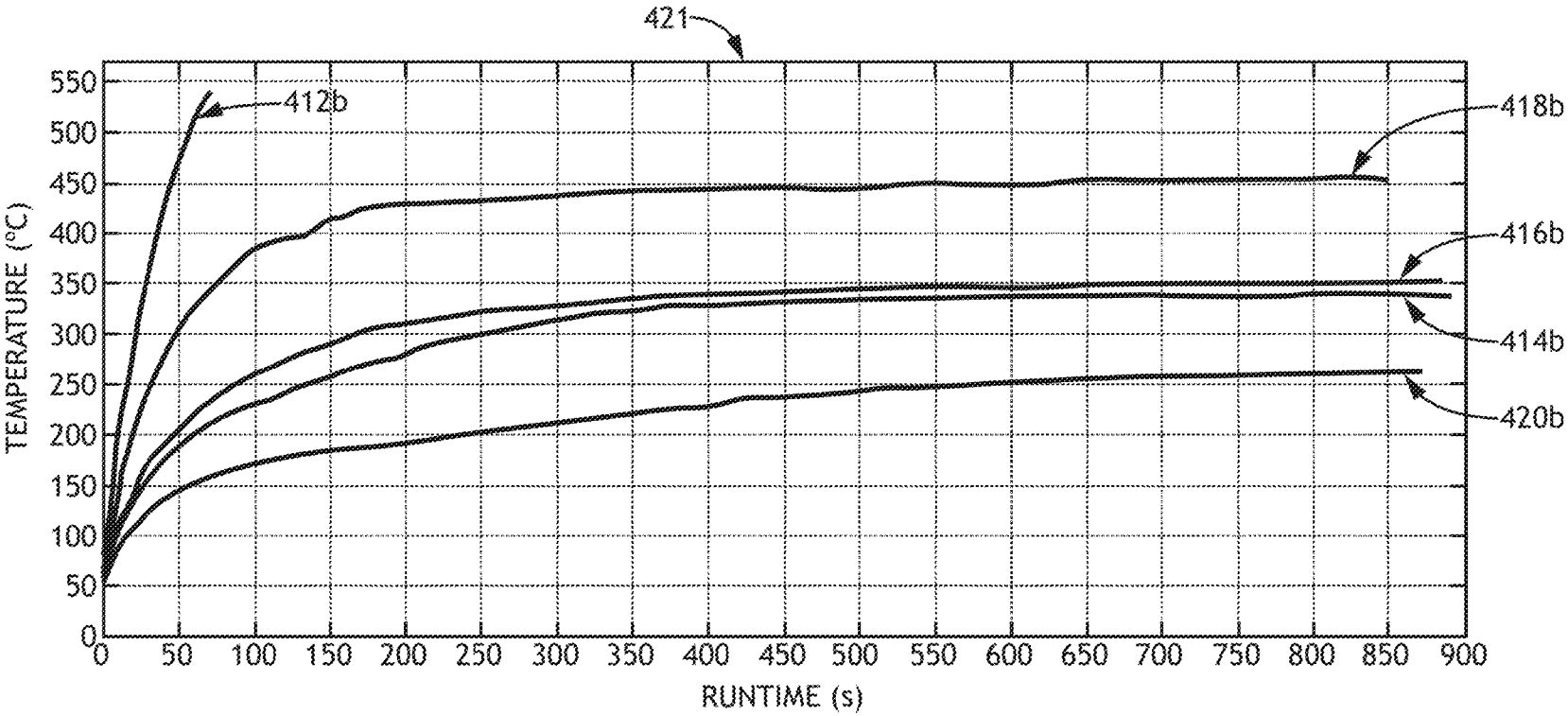
FIG. 4C is a plot of the equator temperature of an elongated plasma bulb containing various gases, in accordance with one embodiment of the present disclosure.

FIGS. 4A through 4C illustrate the evolution of the temperature of a plasma bulb 400 as an illustration of the inhibiting of undesired wavelengths to prevent absorption of radiation by a transparent portion 402 of a plasma bulb 400. FIG. 4A is a simplified schematic diagram of a plasma bulb 400 in which an elongated transparent portion 402 contains a volume of gas 103. It is noted herein that the transparent portion 402 of a plasma bulb 400 is not transparent to all wavelengths and has an absorption spectrum including, but not limited to, UV, EUV, DUV, and/or VUV spectral radiation. Absorption of radiation by the transparent portion 402 of the plasma bulb may lead to direct heating of the transparent portion 402. Additionally, absorption of radiation by a transparent portion 402 may lead to solarization, which may induce further absorption of radiation. As described throughout the present disclosure, the gas mixture 103 may inhibit one or more selected wavelengths of radiation emitted by the plasma 104 such that the one or more selected wavelengths of radiation are do not impinge on the transparent portion 402 of the plasma bulb 402 (or the amount of radiation impinging on the transparent portion is at least reduced). In this regard, undesirable effects such as, but not limited to heating, degradation, or damage to the plasma bulb 400 may be mitigated.

FIG. 4B is a graph 411 illustrating the evolution of the temperature of the plasma bulb 400 at a location 404 (e.g., location 404 of FIG. 3A) for various gases and gas mixtures. Location 404 represents the top shoulder temperature, which serves as an indicator of convection in the plasma bulb 400 as well as absorption of radiation by the transparent portion 402 of the plasma bulb 400. FIG. 4C is a graph 421 illustrating the evolution of the temperature of the plasma bulb 400 at location 406 (e.g. location 406 of FIG. 3A) under the same conditions as described for FIG. 4B. Location 406 represents the equatorial temperature, which is primarily determined by absorption of radiation emitted by the plasma by the transparent portion 402 of the plasma bulb 400.

For each of the plots in graphs 411 and 421, a 2 kW illumination beam was focused into the volume of various gas mixtures 103 contained within the plasma bulb 400 to generate a plasma 104. Plots 412*a*, 412*b* represent a plasma bulb filled with 20 atm of pure argon. Plots 414*a*, 414*b* represent a plasma bulb filled with 20 atm argon and 2 atm xenon. Plots 416*a*, 416*b* represent a plasma bulb filled with 20 atm argon and 5 atm xenon. Plots 418*a*, 418*b* represent a plasma bulb filled with 20 atm argon and 2 atm krypton. Plots 420*a*, 420*b* represent a plasma bulb filled with 20 atm of pure xenon.

As shown in FIGS. 4B and 4C, plasma bulbs 400 filled with either pure argon (plots 412*a*, 412*b*) or pure xenon (plots 420*a*, 420*b*) exhibited sustained temperature increases over a 900 second runtime. Specifically, plots 412*a*, 412*b* cut off at approximately 75 seconds due to a rapid increase in temperature caused by the absorption of radiation emitted by the plasma 104 generated in pure argon by the transparent portion 402 of the plasma bulb 400. Similarly, in the case of pure xenon, plots 420*a*, 420*b* illustrate a sustained temperature increase at the equator of the transparent portion of the plasma bulb 402 caused by the absorption of emitted radiation by the transparent portion 402 of the plasma bulb 402. Plasma bulbs filled with a gas mixture 103 including argon plus xenon or krypton stabilized within approximately two minutes, indicating reduced absorption of radiation emitted by the plasma 104 relative to a plasma bulb filled with pure argon. Further, the stabilized equator temperature provides a relative indication of absorption of radiation by the transparent portion 402 (e.g. absorption of UV, EUV, DUV, or VUV radiation) such that a relatively higher equatorial temperature indicates relatively higher absorption. Conversely, a relatively lower equatorial temperature indicates relatively higher inhibition of emission of undesired wavelengths of radiation by the gas mixture 103. For example, the gas mixture 103 may absorb select wavelengths of radiation emitted by the plasma 104 or quench excimer emission in the gas mixture 103. Consequently, plasma bulbs 400 containing gas mixtures 103 including argon and xenon (e.g., plots 414*b* and 416*b*) result in lower stabilized equatorial temperatures than the plasma bulb 400 containing a gas mixture 103 including argon and krypton (plot 418*b*) and thus provided relatively greater inhibition of undesired wavelengths of radiation (e.g. UV, EUV, DUV, or VUV radiation).

It is noted herein that FIGS. 4B and 4C and the corresponding description provided above, are provided merely for illustrative purposes and should not be interpreted as a limitation on the present disclosure. The precise temperature characteristics of the plasma 104, the temperature of the plasma bulb 400, and the spectrum of radiation absorbed by the gas mixture 103 are dependent on a wide range of factors including, but not limited to, bulb shape, bulb composition, gas pressure, temperature, the spectrum of the generated plasma 104, and/or the absorption spectra of elements of the gas containment structure 102 (e.g. a transparent portion 402). Consequently, FIGS. 4B and 4C and the corresponding description describe one embodiment of the present disclosure. Additional embodiments include, but are not limited to, various compositions of gas mixtures 103, various pump illumination 107 characteristics, various gas containment structure 102 configurations, various spectra of radiation emitted by the generated plasma 104, various spectra of radiation absorbed by the gas mixture 103, and the like.

Figure 5:
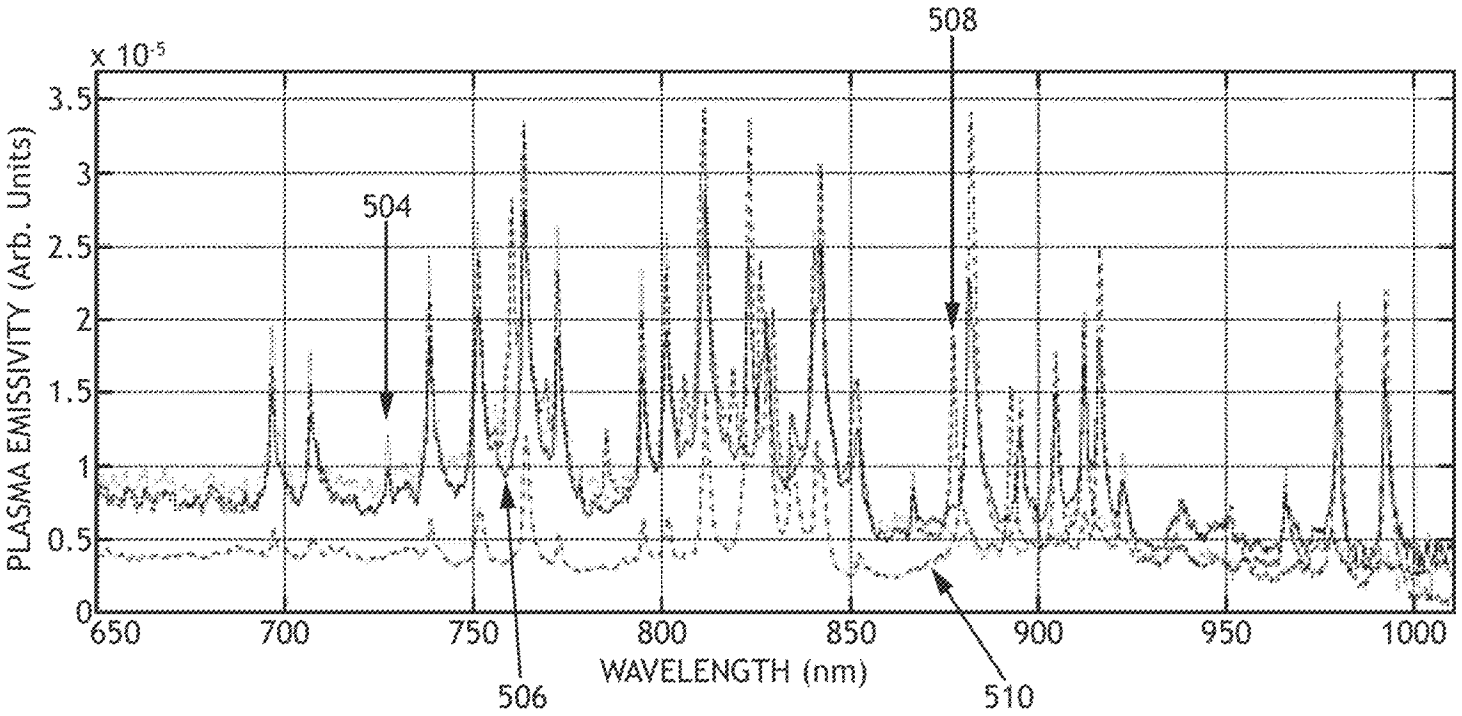
FIG. 5 is a plot of the emission spectrum in the range of 650 nm to approximately 1000 nm of a plasma formed in various gases, in accordance with one embodiment of the present disclosure.

FIG. 5 illustrates the emission spectra in the range of 650 to approximately 1020 nm of plasmas 104 generated in various gases or gas mixtures. In one embodiment, the emission spectrum of plasmas 104 generated in pure argon, a gas mixture 103 including argon and 10% xenon, a gas mixture 103 including argon and 10% krypton, and pure xenon are shown by plots 504, 506, 508, and 510, respectively. It is noted herein that the plots 504 and 510, corresponding to plasmas generated in pure argon and pure xenon, respectively, exhibit significant variations in the relative strengths of emission lines. However, the plasmas generated in a gas mixture 103 including argon and 10% xenon or 10% krypton exhibit only minor modifications in the relative strengths of emission lines relative to plasmas generated in pure argon. In this regard, a gas mixture 103 may include one or more gas components configured to selectively filter one or more select wavelengths of radiation emitted from the plasma 104 with minimal impact on additional emission lines not filtered by the one or more gas components.

Figure 1B:
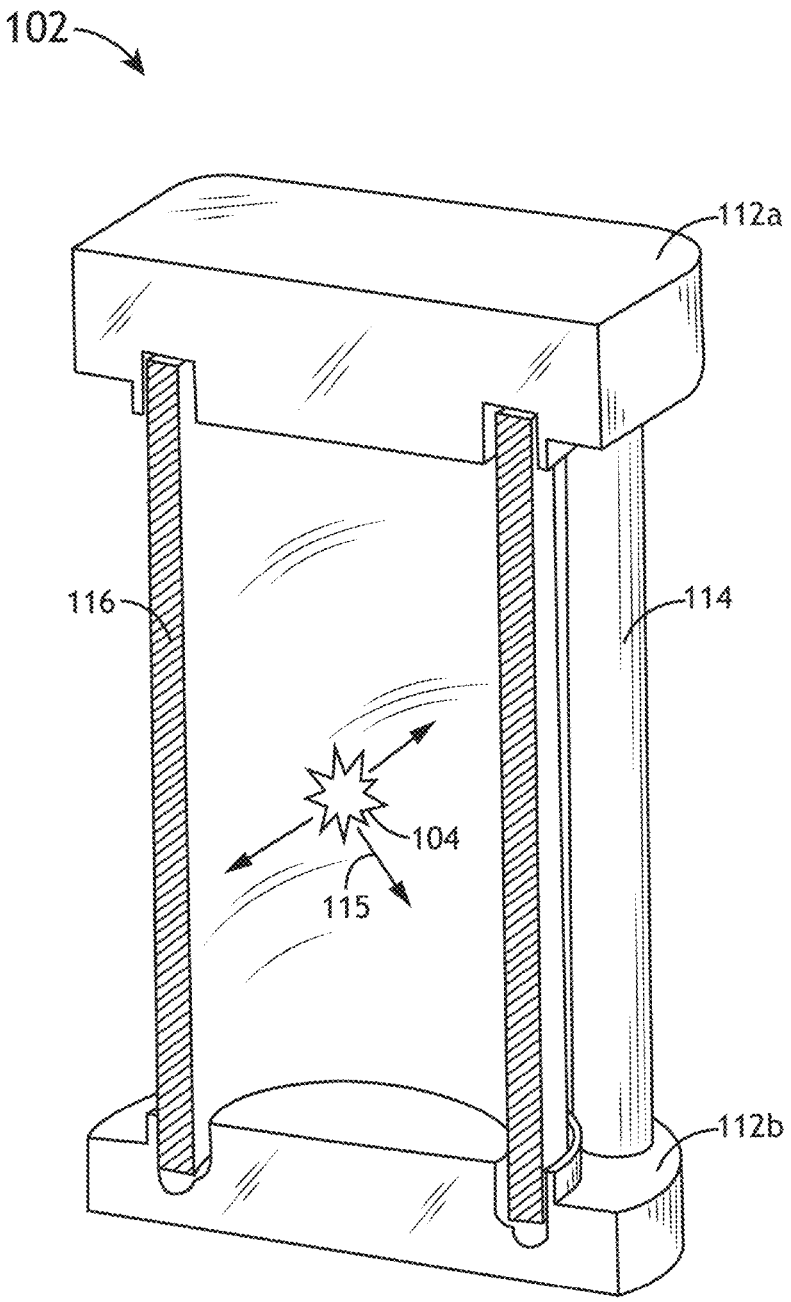
FIG. 1B is a schematic diagram of a plasma cell for containing a gas mixture, in accordance with one embodiment of the present disclosure.

Referring again to FIGS. 1A through 1D, the gas containment structure 102 may include any type of gas containment structure 102 known in the art suitable for initiating and/or maintaining a plasma 104. In one embodiment, as shown in FIG. 1B, the gas containment structure 102 is a plasma cell. In another embodiment, the transparent portion is a transmission element 116. In another embodiment, the transmission element 116 is a hollow cylinder suitable for containing a gas mixture 103. In another embodiment, the plasma cell includes one or more flanges 112*a*, 112*b* coupled to the transmission element 116. In another embodiment, the flanges 112*a*, 112*b* may be secured to the transmission element 116 (e.g., a hollow cylinder) using connection rods 114. The use of a flanged plasma cell is described in at least U.S. patent application Ser. No. 14/231,196, filed on Mar. 31, 2014; and U.S. Pat. No. 9,185,788, filed on May 27, 2014, which are each incorporated previously herein by reference in the entirety.

Figure 1C:
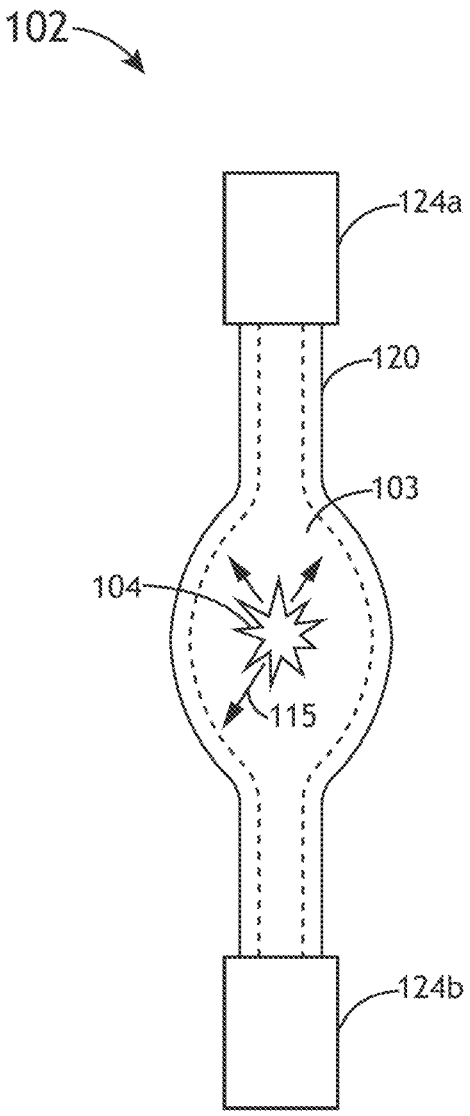
FIG. 1C is a schematic diagram of a plasma bulb for containing a gas mixture, in accordance with one embodiment of the present disclosure.

In another embodiment, as shown in FIG. 1C, the gas containment structure 102 is a plasma bulb. In another embodiment, a transparent portion 120 of the plasma bulb is secured to gas supply assemblies 124*a*, 124*b* configured to supply gas to an internal volume of the plasma bulb. The use of a plasma bulb is described in at least in U.S. patent application Ser. No. 11/695,348, filed on Apr. 2, 2007; U.S. Pat. No. 7,786,455, filed on Mar. 31, 2006; and U.S. Patent Publication No. 2013/0106275, filed on Oct. 9, 2012, which are each incorporated previously herein by reference in the entirety.

Figure 1D:
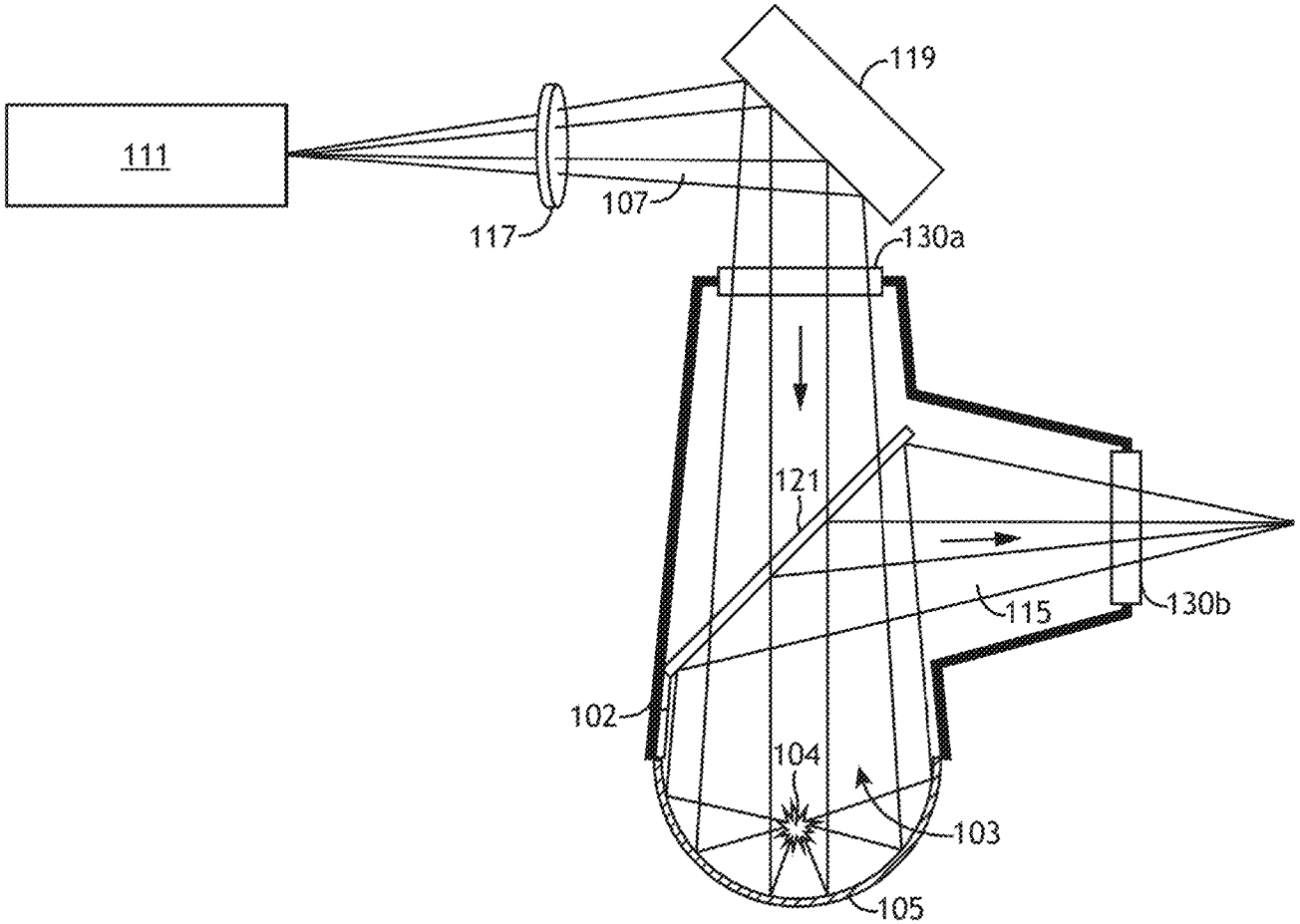
FIG. 1D is a schematic diagram of a plasma chamber for containing a gas mixture, in accordance with one embodiment of the present disclosure.

It is noted herein that the various optical elements (e.g., illumination optics 117, 119, 121; collection optics 105; and the like) may also be enclosed within the gas containment structure 102. In one embodiment, as shown in FIG. 1D, the gas containment structure is a chamber suitable for containing a gas mixture and one or more optical components. In one embodiment, the chamber includes the collector element 105. In another embodiment, one or more transparent portions of the chamber include one or more transmission elements 130. In another embodiment, the one or more transmission elements 130 are configured as entrance and/or exit windows (e.g. 130*a*, 130*b* in FIG. 1D). The use of a self-contained gas chamber is described in U.S. Pat. No. 9,099,292, filed on May 26, 2010, which is incorporated herein by reference in the entirety.

In another embodiment, the transparent portion of the gas containment structure 102 (e.g., plasma cell plasma bulb, chamber and the like) may be formed from any material known in the art that is at least partially transparent to radiation generated by plasma 104. In one embodiment, the transparent portion may be formed from any material known in the art that is at least partially transparent to IR radiation, visible radiation and/or UV radiation 107 from the illumination source 111. In another embodiment, the transparent portion may be formed from any material known in the art that is at least partially transparent to the broadband radiation 115 emitted from the plasma 104. In one embodiment, a gas containment structure 102 contains a gas mixture 103 including one or more gas components to inhibit wavelengths of radiation corresponding to an absorption spectrum of the transparent portion of the gas containment structure 102. With regard to this embodiment, benefits of the inhibition of undesired wavelengths by the gas mixture 103 may include, but are not limited to, reduced damage, reduced solarization, or reduced heating of the transparent portion of the gas containment structure 102.

In some embodiments, the transparent portion of the gas containment structure 102 may be formed from a low-OH content fused silica glass material. In other embodiments, the transparent portion of the gas containment structure 102 may be formed from high-OH content fused silica glass material. For example, the transparent portion of the gas containment structure 102 may include, but is not limited to, SUPRASIL 1, SUPRASIL 2, SUPRASIL 300, SUPRASIL 310, HERALUX PLUS, HERALUX-VUV, and the like. In other embodiments, the transparent portion of the gas containment structure 102 may include, but is not limited to, $CaF_2$, $MgF_2$, LiF, crystalline quartz and sapphire. It is noted herein that materials such as, but not limited to, $CaF_2$, $MgF_2$, crystalline quartz and sapphire provide transparency to short-wavelength radiation (e.g., $\lambda<190$ nm). Various glasses suitable for implementation in the transparent portion 108 of the gas containment structure 102 (e.g., chamber window, glass bulb, glass tube or transmission element) of the present disclosure are discussed in detail in A. Schreiber et al., *Radiation Resistance of Quartz Glass for VUV Discharge Lamps*, J. Phys. D: Appl. Phys. 38 (2005), 3242-3250, which is incorporated herein by reference in the entirety. It is noted herein that fused silica does provide some transparency to radiation having wavelength shorter than 190 nm, showing useful transparency to wavelengths as short as 170 nm.

The transparent portion of the gas containment structure 102 may take on any shape known in the art. In one embodiment, the transparent may have a cylindrical shape, as shown in FIGS. 1A and 1B. In another embodiment, although not shown, the transparent portion may have a spherical shape. In another embodiment, although not shown, the transparent portion may have a composite shape. For example, the shape of the transparent portion may consist of a combination of two or more shapes. For instance, the shape of the transparent portion may consist of a spherical center portion, arranged to contain the plasma 104, and one or more cylindrical portions extending above and/or below the spherical center portion, whereby the one or more cylindrical portions are coupled to one or more flanges 112.

The collector element 105 may take on any physical configuration known in the art suitable for focusing illumination emanating from the illumination source 111 into the volume of gas 103 contained within the transparent portion 108 of the gas containment structure 102. In one embodiment, as shown in FIG. 1A, the collector element 105 may include a concave region with a reflective internal surface suitable for receiving illumination 113 from the illumination source 111 and focusing the illumination 113 into the volume of gas 103 contained within the gas containment structure 102. For example, the collector element 105 may include an ellipsoid-shaped collector element 105 having a reflective internal surface, as shown in FIG. 1A. As another example, the collector element 105 may include a spherical-shaped collector element 105 having a reflective internal surface.

In another embodiment, the collector element 105 collects broadband radiation 115 emitted by plasma 104 and directs the broadband radiation 115 to one or more downstream optical elements. For example, the one or more downstream optical elements may include, but are not limited to, a homogenizer 125, one or more focusing elements, a filter 123, a stirring mirror and the like. In another embodiment, the collector element 105 may collect broadband radiation 115 including EUV, DUV, VUV, UV, visible and/or infrared radiation emitted by plasma 104 and direct the broadband radiation to one or more downstream optical elements. In this regard, the gas containment structure 102 may deliver EUV, DUV, VUV, UV, visible, and/or infrared radiation to downstream optical elements of any optical characterization system known in the art, such as, but not limited to, an inspection tool or a metrology tool. For example, the LSP system 100 may serve as an illumination sub-system, or illuminator, for a broadband inspection tool (e.g., wafer or reticle inspection tool), a metrology tool or a photolithography tool. It is noted herein the gas containment structure 102 of system 100 may emit useful radiation in a variety of spectral ranges including, but not limited to, EUV, DUV radiation, VUV radiation, UV radiation, visible radiation, and infrared radiation.

In one embodiment, system 100 may include various additional optical elements. In one embodiment, the set of additional optics may include collection optics configured to collect broadband light emanating from the plasma 104. For instance, the system 100 may include a cold mirror 121 arranged to direct illumination from the collector element 105 to downstream optics, such as, but not limited to, a homogenizer 125.

In another embodiment, the set of optics may include one or more additional lenses (e.g., lens 117) placed along either the illumination pathway or the collection pathway of system 100. The one or more lenses may be utilized to focus illumination from the illumination source 111 into the volume of gas 103. Alternatively, the one or more additional lenses may be utilized to focus broadband light emitted by the plasma 104 onto a selected target (not shown).

In another embodiment, the set of optics may include a turning mirror 119. In one embodiment, the turning mirror 119 may be arranged to receive illumination 113 from the illumination source 111 and direct the illumination to the volume of gas 103 contained within the transparent portion 108 of the gas containment structure 102 via collection element 105. In another embodiment, the collection element 105 is arranged to receive illumination from mirror 119 and focus the illumination to the focal point of the collection element 105 (e.g., ellipsoid-shaped collection element), where the transparent portion 108 of the gas containment structure 102 is located.

In another embodiment, the set of optics may include one or more filters 123. In another embodiment, one or more filters 123 are placed prior to the gas containment structure 102 to filter pump illumination 107. In another embodiment, one or more filters are placed after the gas containment structure 102 to filter radiation emitted from the gas containment structure.

In another embodiment, the illumination source 111 is adjustable. For example, the spectral profile of the output of the illumination source 111 may be adjustable. In this regard, the illumination source 111 may be adjusted in order to emit a pump illumination 107 of a selected wavelength or wavelength range. It is noted that any adjustable illumination source 111 known in the art is suitable for implementation in the system 100. For example, the adjustable illumination source 111 may include, but is not limited to, one or more adjustable wavelength lasers.

In another embodiment, the illumination source 111 of system 100 may include one or more lasers. In a general sense, the illumination source 111 may include any laser system known in the art. For instance, the illumination source 111 may include any laser system known in the art capable of emitting radiation in the infrared, visible or ultraviolet portions of the electromagnetic spectrum. In one embodiment, the illumination source 111 may include a laser system configured to emit continuous wave (CW) laser radiation. For example, the illumination source 111 may include one or more CW infrared laser sources. For example, in settings where the gas of the volume 103 is or includes argon, the illumination source 111 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting and any laser known in the art may be implemented in the context of the present disclosure.

In another embodiment, the illumination source 111 may include one or more diode lasers. For example, the illumination source 111 may include one or more diode laser emitting radiation at a wavelength corresponding with any one or more absorption lines of the species of the gas mixture contained within volume 103. In a general sense, a diode laser of the illumination source 111 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the gas containment structure 102 of system 100.

In another embodiment, the illumination source 111 may include an ion laser. For example, the illumination source 111 may include any noble gas ion laser known in the art. For instance, in the case of an argon-based plasma, the illumination source 111 used to pump argon ions may include an Ar+ laser.

In another embodiment, the illumination source 111 may include one or more frequency converted laser systems. For example, the illumination source 111 may include a Nd:YAG or Nd:YLF laser having a power level exceeding 100 Watts. In another embodiment, the illumination source 111 may include a broadband laser. In another embodiment, the illumination source may include a laser system configured to emit modulated laser radiation or pulsed laser radiation.

In another embodiment, the illumination source 111 may include one or more lasers configured to provide laser light at substantially a constant power to the plasma 106. In another embodiment, the illumination source 111 may include one or more modulated lasers configured to provide modulated laser light to the plasma 104. In another embodiment, the illumination source 111 may include one or more pulsed lasers configured to provide pulsed laser light to the plasma 104.

In another embodiment, the illumination source 111 may include one or more non-laser sources. In a general sense, the illumination source 111 may include any non-laser light source known in the art. For instance, the illumination source 111 may include any non-laser system known in the art capable of emitting radiation discretely or continuously in the infrared, visible or ultraviolet portions of the electromagnetic spectrum.

It is noted herein that the set of optics of system 100 as described above and illustrated in FIGS. 1A through 1D are provided merely for illustration and should not be interpreted as limiting. It is anticipated that a number of equivalent optical configurations may be utilized within the scope of the present disclosure.

Figure 6:
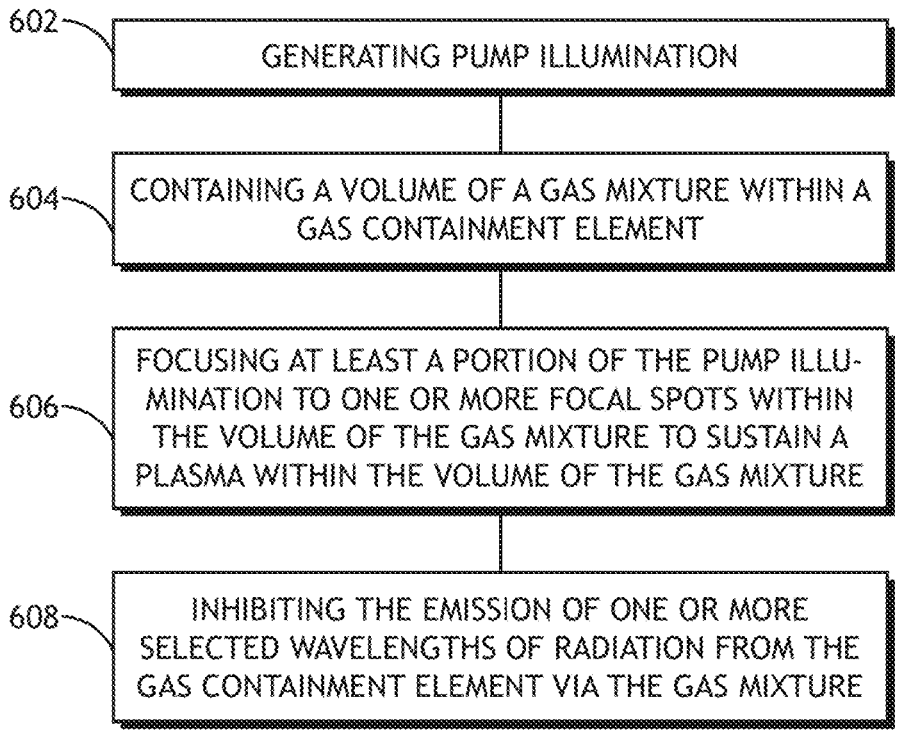
FIG. 6 is a flow diagram illustrating a method for generating laser-sustained plasma light, in accordance with one embodiment of the present disclosure.

FIG. 6 illustrates a flow diagram depicting a method for generating laser-sustained plasma radiation, in accordance with one or more embodiments of the present disclosure.

In step 602, pump illumination 107 is generated. In one embodiment, the pump illumination 107 is generated using one or more lasers. In another embodiment, the pump illumination is generated with a CW laser configured to emit radiation at 1069 nm.

In step 604, a volume of a gas mixture 103 is contained within a gas containment structure 102 (e.g. a plasma cell, a plasma bulb, a chamber, or the like). In another embodiment, the gas mixture includes a first gas component at a first partial pressure and a second gas component including one or more additional gases at a second partial pressure.

In step 606, at least a portion of the pump illumination 107 is focused to one or more focal spots within the volume of the gas mixture 103 to sustain the plasma 104 within the volume of the gas mixture 103. In another embodiment, a collector element 105 simultaneously focuses pump illumination 107 within the volume of the gas mixture 103 and collects radiation 115 emitted from the gas containment structure 102.

In step 608, the gas mixture 103 inhibits the emission of one or more selected wavelengths of radiation from the gas containment structure 102. In another embodiment, the gas mixture 103 absorbs one or more selected wavelengths emitted by the plasma 104. In another embodiment, one or more components of the gas mixture 103 quench excimer emission from the gas mixture 103. In another embodiment, the gas mixture 103 both absorbs one or more selected wavelengths emitted by the plasma 104 and quenches excimer emission from the gas mixture 103.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the disclosure is defined by the appended claims.

What is claimed is:

1. A system for forming a laser-sustained plasma, comprising:

a gas containment element, wherein the gas containment element is configured to contain a volume of a gas mixture;

an illumination source configured to generate pump illumination; and a collector element configured to focus the pump illumination from the pumping source into the volume of the gas mixture contained within the gas containment element in order to generate a plasma within the volume of the gas mixture, wherein the plasma emits broadband radiation, wherein the gas mixture inhibits the emission of one or more selected wavelengths of radiation from the gas containment element.

2. The system of claim 1, wherein the gas containment element includes at least one of a chamber, a plasma bulb or a plasma cell.

3. The system of claim 1, wherein the broadband radiation including one or more selected wavelengths emitted by the plasma includes in at least one of infrared wavelengths, visible wavelengths, UV wavelengths, DUV wavelengths, VUV wavelengths, or EUV wavelengths.

4. The system of claim 1, wherein the one or more selected wavelengths of radiation inhibited by the gas mixture include wavelengths lower than 600 nm.

5. The system of claim 1, wherein the gas mixture absorbs the one or more selected wavelengths of radiation emitted by the plasma.

6. The system of claim 1, wherein the gas mixture comprises:

at least two of the group including argon, mercury, xenon, krypton, radon, neon and at least one metal halide compound.

7. The system of claim 1, wherein the gas mixture comprises:

at least one of argon or neon having a first partial pressure of at least 10 atmospheres; and an additional gas component including at least one of xenon, krypton, or radon, the additional gas component having a second partial pressure of less than 20% of the first partial pressure.

8. The system of claim 1, wherein the gas mixture includes one or more gas components to quench radiative emission of excimers in the gas mixture.

9. The system of claim 8, wherein the one or more gas components substantially quench radiative emission of excimers in the gas mixture by at least one of collisional dissociation, a photolytic process, or resonance excitation transfer.

10. The system of claim 8, wherein the one or more gas components include at least one of $O_2$, $N_2$, $CO_2$, $H_2O$, $SF_6$, $I_2$, $Br_2$ or Hg.

11. The system of claim 8, wherein the gas mixture includes xenon and at least one of $O_2$ or $N_2$.

12. The system of claim 8, wherein the gas mixture includes neon and $H_2$.

13. The system of claim 8, wherein the gas mixture includes argon and at least one of xenon or $N_2$.

14. The system of claim 1, wherein the collector element is arranged to collect at least a portion of the broadband radiation emitted by the plasma and direct the broadband radiation to one or more additional optical elements.

15. The system of claim 1, wherein the gas mixture inhibits radiation including wavelengths within an absorption spectrum of one or more propagation elements.

16. The system of claim 15, wherein the one or more propagation elements comprise:

at least one of the collector element, a transmission element, a reflective element, or a focusing element.

17. The system of claim 15, wherein the one or more propagation elements are formed from at least one of crystalline quartz, sapphire, fused silica, calcium fluoride, lithium fluoride, or magnesium fluoride.

18. The system of claim 1, wherein inhibiting radiation by the gas mixture inhibits damage to one or more components of the system.

19. The system of claim 18, wherein the damage includes solarization.

20. The system of claim 1, wherein the gas mixture inhibits radiation including wavelengths within an absorption spectrum of one or more additional elements.

21. The system of claim 20, wherein the one or more additional elements comprise:

at least one of a flange or a seal.

22. The system of claim 1, wherein the illumination source comprises:

one or more lasers.

23. The system of claim 22, wherein the one or more lasers comprise:

one or more infrared lasers.

24. The system of claim 22, wherein the one or more lasers comprise:

at least one of a diode laser, a continuous wave laser, or a broadband laser.

25. The system of claim 1, wherein the illumination source comprises:

an illumination source configured to emit pump illumination at a first wavelength and illumination at an additional wavelength different from the first wavelength.

26. The system of claim 1, wherein the illumination source comprises:

an adjustable illumination source, wherein a wavelength of the pump illumination emitted by the illumination source is adjustable.

27. The system of claim 1, wherein the collector element is positioned external to the gas containment element.

28. The system of claim 1, wherein the collector element is positioned internal to the gas containment element.

29. The system of claim 1, wherein the collector element comprises:

at least one of an ellipsoid-shaped collector element or a spherical-shaped collector element.

30. A plasma lamp for forming a laser-sustained plasma, comprising:

a gas containment element, wherein the gas containment element is configured to contain a volume of a gas mixture, wherein the gas mixture is further configured to receive pump illumination in order to generate a plasma within the volume of the gas mixture, wherein the plasma emits broadband radiation, wherein the gas mixture inhibits the emission of one or more selected wavelengths of radiation from the gas containment element.

31. A method for generating laser-sustained plasma radiation, comprising:

generating pump illumination;

containing a volume of a gas mixture within a gas containment structure;

focusing at least a portion of the pump illumination to one or more focal spots within the volume of the gas mixture to sustain a plasma within the volume of the gas mixture, wherein the plasma emits broadband radiation; and inhibiting the emission of one or more selected wavelengths of radiation from the gas containment structure via the gas mixture.

* * * * *